US005428928A

United States Patent [19]

Hellwig et al.

[11] Patent Number: 5,428,928

[45] Date of Patent: Jul. 4, 1995

[54] DESKING SYSTEM

[75] Inventors: John Hellwig, Toronto; David M. Stevenson, Barrie; Lorie Marangoni, Weston, all of Canada

[73] Assignee: Teknion Furniture Systems, Downsview, Canada

[21] Appl. No.: 263,418

[22] Filed: Jun. 21, 1994

Related U.S. Application Data

[63] Continuation of Ser. No. 878,218, May 4, 1992, abandoned.

[51] Int. Cl.[6] ..... E04B 2/74

[52] U.S. Cl. ..... 52/239; 52/36.1; 52/36.4; 248/188.5; 108/147

[58] Field of Search ..... 52/36.1, 36.4, 36.5, 52/36.6, 239; 248/188.5, 411, 412; 108/50, 48, 42, 147

[56] References Cited

U.S. PATENT DOCUMENTS

| | | | |
|---|---|---|---|
| 4,685,255 | 8/1987 | Kelley | 52/36.1 |
| 4,821,477 | 4/1989 | Rydquist | 52/36.1 |
| 4,914,873 | 4/1990 | Newhouse | 52/239 |
| 4,932,177 | 6/1990 | Hinden | 52/239 |
| 5,197,393 | 3/1993 | Yeakle | 108/147 |
| 5,214,890 | 6/1993 | Levitan et al. | 52/239 |
| 5,241,796 | 9/1993 | Hellwig et al. | 52/36.4 |

FOREIGN PATENT DOCUMENTS 0458264 11/1991 European Pat. Off. .

*Primary Examiner*—Carl D. Friedman
*Assistant Examiner*—Winnie S. Yip

[57] ABSTRACT

The present invention relates to a combined desking and panelling system which provides an effective means for subdividing office space and defining work areas. Work surfaces are provided and can be independently supported or supported by the panelling system. Power and communication wires and cables are distributed through and between the desking and panelling systems.

12 Claims, 8 Drawing Sheets

DESKING SYSTEM

This application is a continuation of abandoned application Ser. No. 07/878,218 filed May 4, 1992.

FIELD OF THE INVENTION

The present invention relates to office panelling systems and to desking systems. In particular, the invention relates to a combination panelling and desking system.

BACKGROUND OF THE INVENTION

Office panelling systems are now recognized as one of the best approaches for subdividing office space into individual work units or cells due to the flexibility of such systems to be changed to meet changing needs as well as the ability of the system to be dissembled and moved to other sites. Panelling systems now have the capability of conveniently providing high capacity power to particular work stations as well as allowing the distribution of communication wires and the like to work stations.

TEKNION* office panelling systems have gained wide acceptance in the marketplace and the structure of this panelling system is generally shown in U.S. Pat. No. 4,535,577, which is incorporated herein by reference. This system has individual office panels interconnected, with each office panel having an interior frame which supports decorative or functional cover elements to the exterior of the frame. Various horizontal channels are provided for securing of office accessories, such as work surfaces and overhead bins. This panelling system has gained wide acceptance in the marketplace and provides power at desk height.

*TEKNION—trademark of TEKNION FURNITURE SYSTEMS

Panelling systems which support work surfaces to either side thereof are the most common system in North America, whereas in Europe, the approach has been to provide a desking system which is capable of supporting panels or partitions thereon. These two alternative approaches each have advantages and disadvantages. For example, in some cases, it is desirable to have a number of work surfaces laid out in a particular arrangement without any panels associated therewith. In other cases, it is desirable to merely subdivide the space without the need for work surfaces. In the first case, a desking system is more desirable, whereas in the second case, a panelling system is more desirable. These systems, because of the different principles involved, operate basically independently of the other type of system. There remains a need to provide a system which addresses the various demands of the marketplace while accommodating the ability to readily alter any work space environment. There also remains a need to provide a system where the storage of additional components is reduced.

SUMMARY OF THE INVENTION

A system for dividing an open area into working arrangements, according to the present invention, comprises a number of interconnected panels supporting work surfaces to the sides thereof and a desking arrangement having as part thereof supported work surfaces, wherein the work surfaces of the system are interchangeable and can be supported by either the desking arrangement or the panels.

According to an aspect of the invention, the work surfaces are releasably supported and can be removed or installed without requiring tools.

According to yet a further aspect of the invention, the system includes a supply of work surfaces of various configurations, with this supply of work surfaces accommodating changes in the work surface configuration of the overall system. With this arrangement, the support structure for supporting the work surfaces either to a panel or the supports for defining work surfaces of the desking arrangement conveniently releasably support the work surfaces, such that the work surfaces are readily interchangeable with other work surfaces, whereby greater flexibility is possible. With this arrangement, only the work surfaces or an extra supply of work surfaces need to be stored as opposed to a complete supply of desks. Furthermore, with this arrangement, the support structure for the work surfaces can be knocked down, thus reducing storage difficulties.

According to another aspect of the invention, a number of the work surfaces include at least one end configuration for at least partially defining a transition in the longitudinal axis of the work surface, which transition occurs between two adjacent work surfaces.

In the past, separate junction members have been used to join two separate work surfaces. It has been found that work surfaces, at least partially defining a transition or fully defining a transition such that the transition is integral with the work surface, simplify the overall system and allow for great flexibility in modifying the layout to meet specialized needs.

A combination office panelling and office desking system, according to the present invention, comprises office panels supporting to one side thereof work surfaces which cooperate with work surfaces of the office desking system to define continuous or interrelated work surfaces at the transition between work surfaces of the panelling system and the desking system. The panelling system includes means for supporting the work surfaces and the desking system includes means for supporting the work surfaces, with these work surfaces being supported by either the panelling system or the desking system.

According to an aspect of the invention, the distribution of electrical power and/or communication wiring is easily accomplished and can pass from panel to desking system or desking system to panel.

According to a preferred aspect of the invention, the electrical power and communication wiring are each maintained interior to the panelling system or the desking system.

According to yet another aspect of the invention the electrical and communication cables can be laid in place without threading through the desking system.

The invention also relates to a system for subdividing in open areas by means of panels and desking arrangements which have cooperating working surfaces at desk height whereby the work surface is non-disjunctive at points of transition between work surface supported by panels and work surfaces supported by said desking arrangement.

A desking system according to the present invention has a number of desks cooperating to define as work surface arrangement. At least one of the desks has two opposed telescopic leg arrangements interconnected by a beam assembly fixedly secured to the lower telescopic sections and defining a modesty panel of the at least one desk. The beam assembly includes an open channel means for having laid therein wires, cables and/or power cables. The at least one desk has means for varying the height of a work surface supported by said telescopic legs. The means for varying telescoping said legs as required to vary the height of said work surface, whereby the work surface is of variable height and the height of said connecting beam remains fixed.

BRIEF DESCRIPTION OF THE DRAWINGS

Preferred embodiments of the invention are shown in the drawings, wherein.

DETAILED DESCRIPTION OF THE PREFERRED EMBODIMENTS

Figure 3:
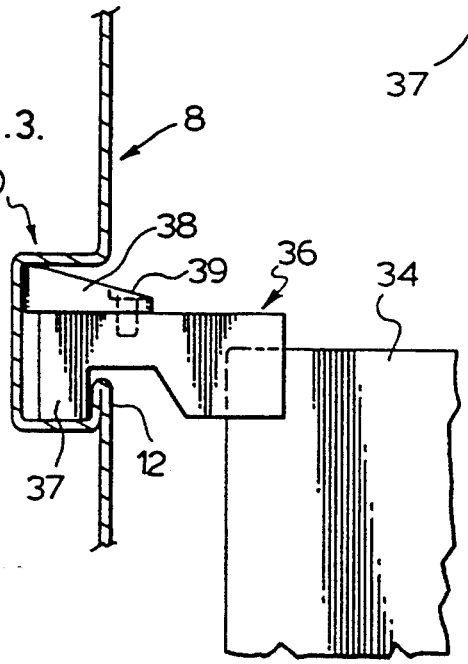
FIG. 3 is a vertical view showing securement of one support member to the frame of an office panelling system.

The combination office panelling and desking system 1 shown in the drawings comprises an office panelling system, generally shown as 2, made up of individual office panels 4 all interconnected and which interact to support one another. The individual office panels 4 have removable cover or functional elements 6 supported to one side of a panel frame 8. Securing channels 10, shown in FIG. 3, are accessible at the horizontal junction between stacked cover or functional elements 6.

The desking system is generally shown as 20 and is the portion of the system which is supported independently of the panelling system 2. Work surface 40 is directly supported by the desking system 20 by means of support arrangements 42. The ends 44 and 46 of the work surface 40 have as part thereof transition segments 45 and 47. These transition segments accommodate a change in direction of the longitudinal axis of the work surfaces 30 and 40.

Figure 2:
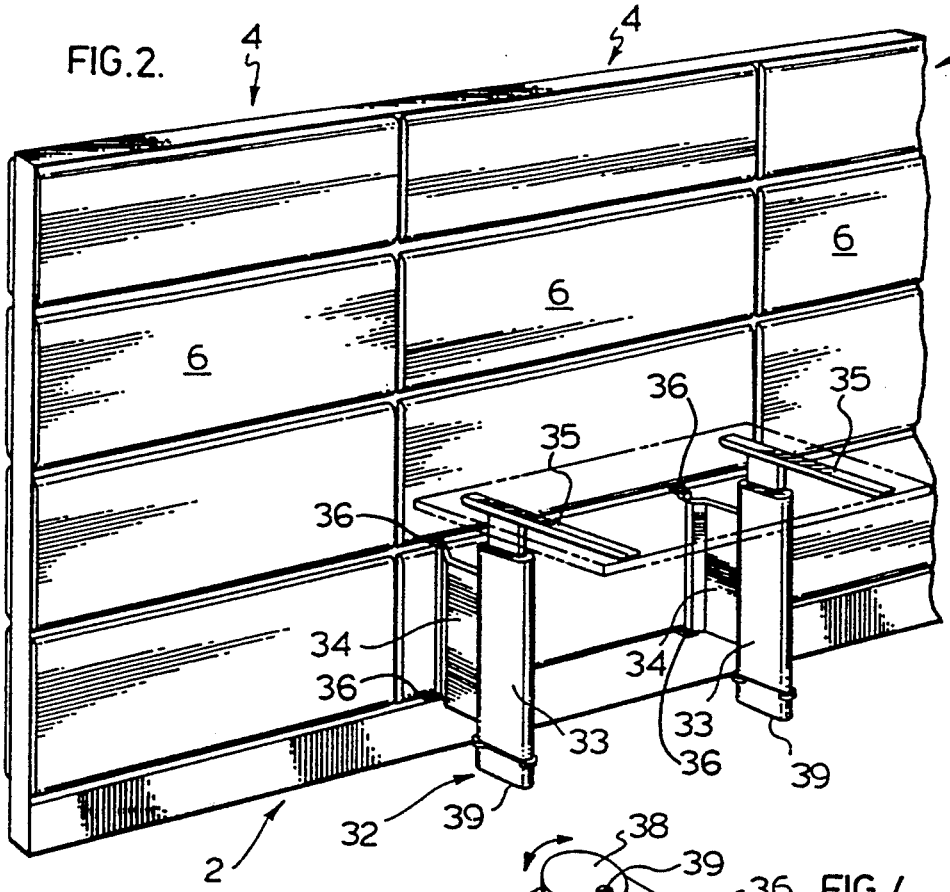
FIG. 2 is a partial perspective view showing securement of a working surface to the panelling system.
Figure 4:
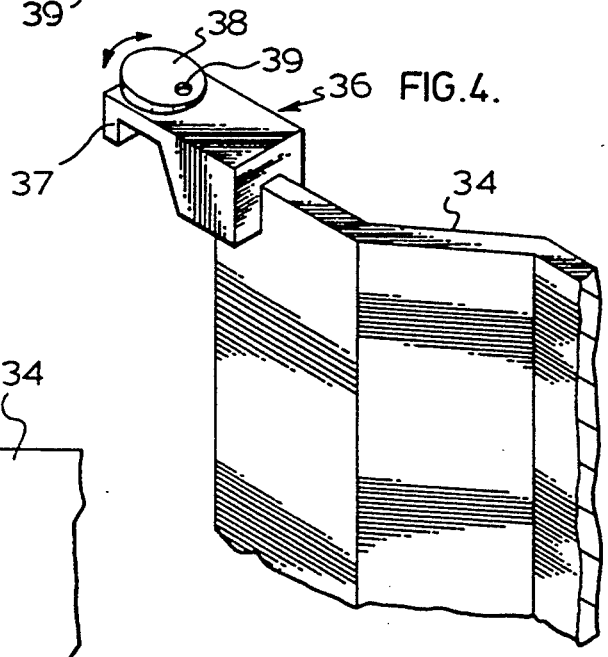
FIG. 4 is a partial perspective view showing one arrangement for securing of a support arrangement to the frame of an office panel.

Work surface 30 is supported by the panelling system and the support arrangement 32 which is connected directly to a panel 4. Each support arrangement 32 engages a panel and also includes a support surface 39 engaging the floor. The support arrangement 32 includes legs 33, rearwardly extending connecting sections 34, a panel engaging bracket 36 at the top and bottom of the rearwardly extending connection section 34, with each panel engaging bracket 36 having a hook 37 and a rotatable cam 38 pivotted atop the bracket around a pivot pin 39. As shown in FIG. 3, the bracket 36 has its hook received within the channel 10 of a frame with the channel having a lower lip 12. The hook is thus trapped behind the lower lip by means of the cam 38 which is rotated and forced into engagement with the top surface of the channel 10 or the rear surface of the channel 10. The hook 37 becomes trapped within the channel and, thus, positively engages the support arrangement 32 with the channels 10 of the panels 4. These support arrangements 32 with the cam in a release position, are free to slide along the length of the channel and be at any place along the length of the channel. This provides great freedom with respect to the use of these support structures and allows appropriate placement of these support arrangements 32 in accordance with the particular legs of the work surface being supported. Details of this engagement and of the support arrangement 32 are shown in FIGS. 2, 3 and 4.

Figure 5:
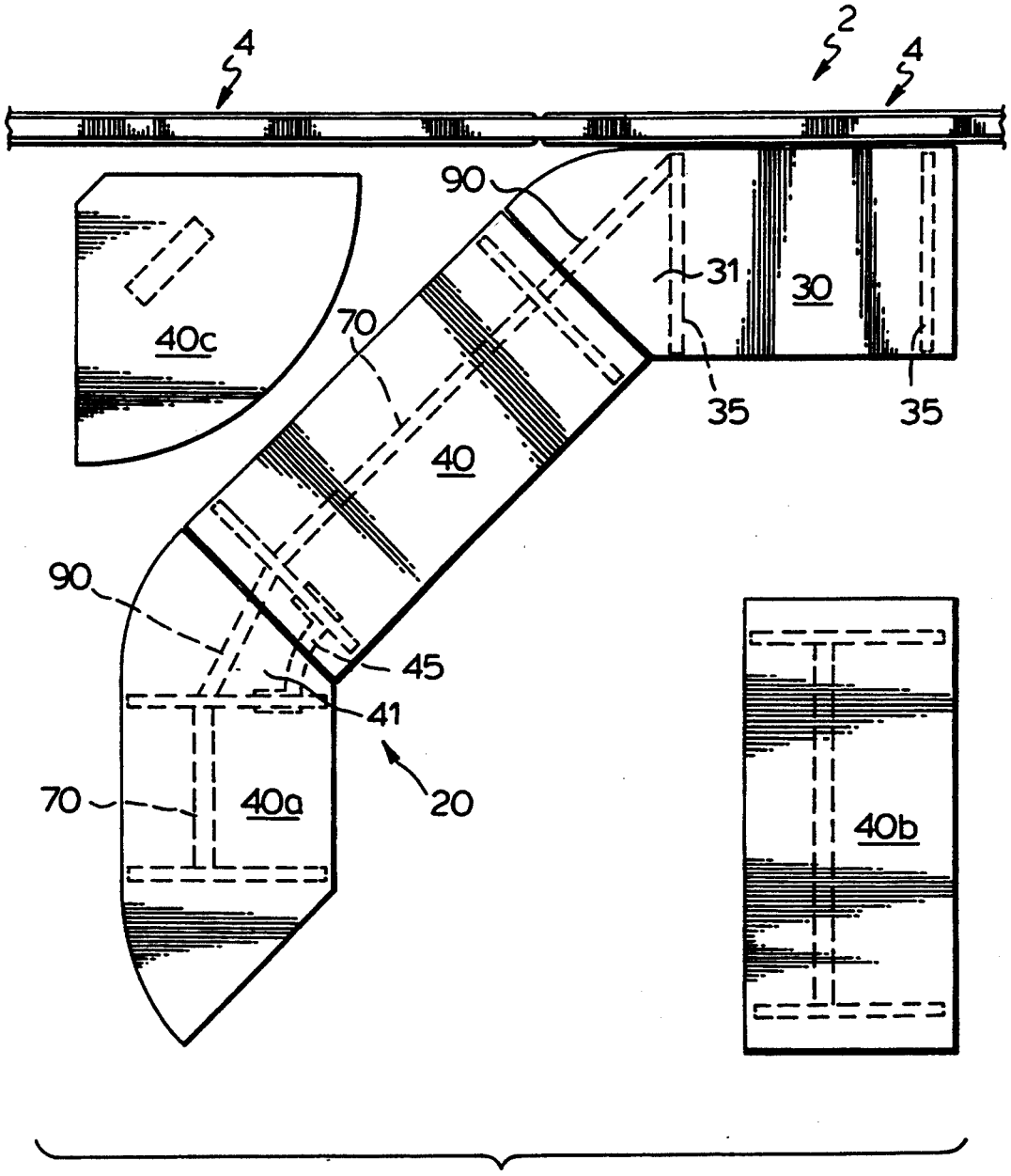
FIG. 5 is a top view showing a combination office panelling and desking system.

The combined office panelling and desking system is partially shown in FIG. 5 where it can be seen that the panelling system 2 is extending in a generally straight line defined by the individual connected panels 4 and have associated therewith a work surface 30 supported from the panels 4. Work surface 30 includes a transition section 31 which mates with the work surface 40 adjacent thereto. Work surface 40 is supported by the desking system and the individual legs shown in dotted lines and running from adjacent the front edge of work surface 40 to the back edge of work surface 40. Work surface **40*a* includes a transition segment 41 which cooperates with surface 40 to provide a further change in direction of the longitudinal axis of the work surface defined collectively by work surface 30, work surface 40 and work surface 40*a*. It should be noted that the transitional segments 31 and 41 are integral with the respective work surfaces and form a cantilevered arrangement. Thus, it can be seen that a smooth transition has been provided between the work surfaces supported from the panel and a separate section where the work surface is supported by the desking system 20 defined by the two abutting work surfaces. In the lower right-hand portion of the Figure, a separate desk supporting work surface 40*b* has been provided. Thus, it can be seen that the desking system can support individual working surfaces, such as 40*b*, or it can cooperate and support other work surfaces 40 and 40*a*. The segments 35 associated with work surface 30 are supports attached at the top of legs 33 and preferably releasably engage rails on the underside of the work surface. A spring detente arrangement 102 can be used to secure the work surface similar to that shown in FIGS. 7 and 8**.

Figure 10:
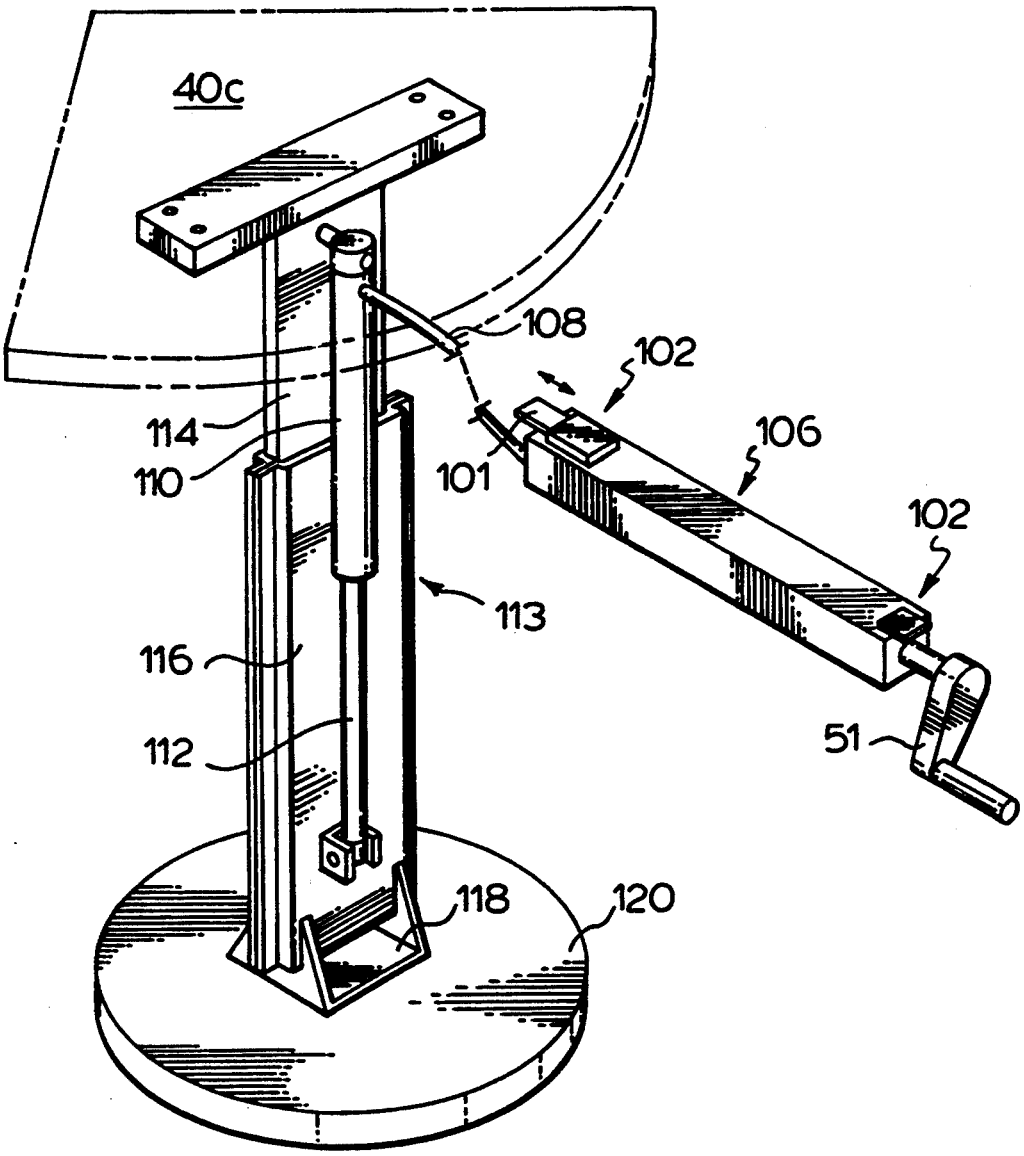
FIG. 10 is a perspective view of a height adjustable monitor support table.
Figure 11:
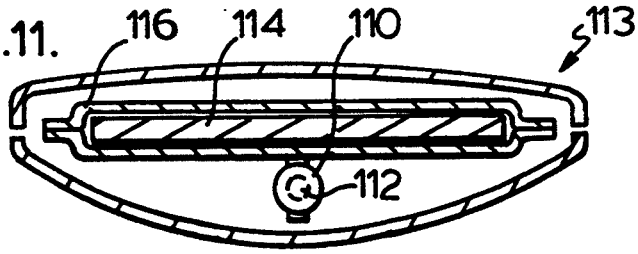
FIG. 11 is a sectional view of the central support of the monitor support table with covers.

A raised pedestal work surface **40*c* is shown and details of that support arrangement are illustrated in FIG. 10**.

Figure 5A:
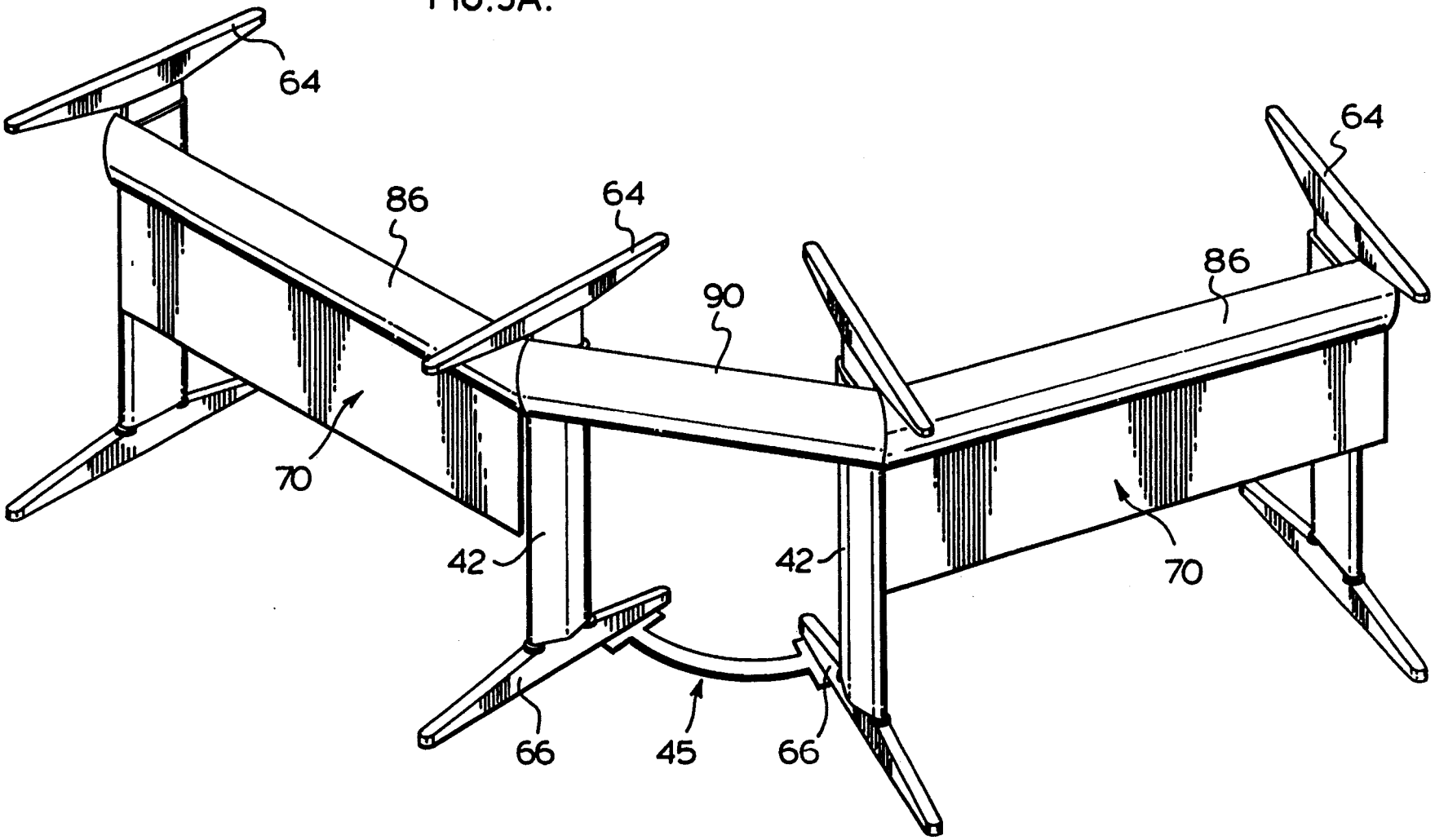
FIG. 5A is a perspective view showing a floor plate locking the angular relationship of two adjacent feet of the desking system.

The desking system includes a foot bracket 45 shown in FIG. 5A which engages the each foot 66 of adjacent leg supports 42 whereby adjacent feet of support legs can be mechanically fixed. Various different floor plates can be provided for different angular relationships. These floor plates also simplify initial installation. This serves to retain the abutting relationship of adjacent work surfaces whereby the work surfaces are not directly connected one to the others. The connecting conduit 90 mechanically interconnects the structure of the lower support legs, providing a further mechanical connection retaining the predetermined relationship. In this way, adjacent legs of the desking system are mechanically engaged at two vertical positions while allowing the height of adjacent work surfaces to be independently varied.

With the arrangement the work surfaces need not be the same level and can be independently adjusted in height as may be required for particular function.

Each desk unit includes a beam assembly 70 which forms a modesty panel. Connecting conduits 90 form an extension of the modesty panel and mechanically connect one such modesty panel to an adjacent modesty panel or an office panel. Further details are shown in FIG. 6.

Figure 6:
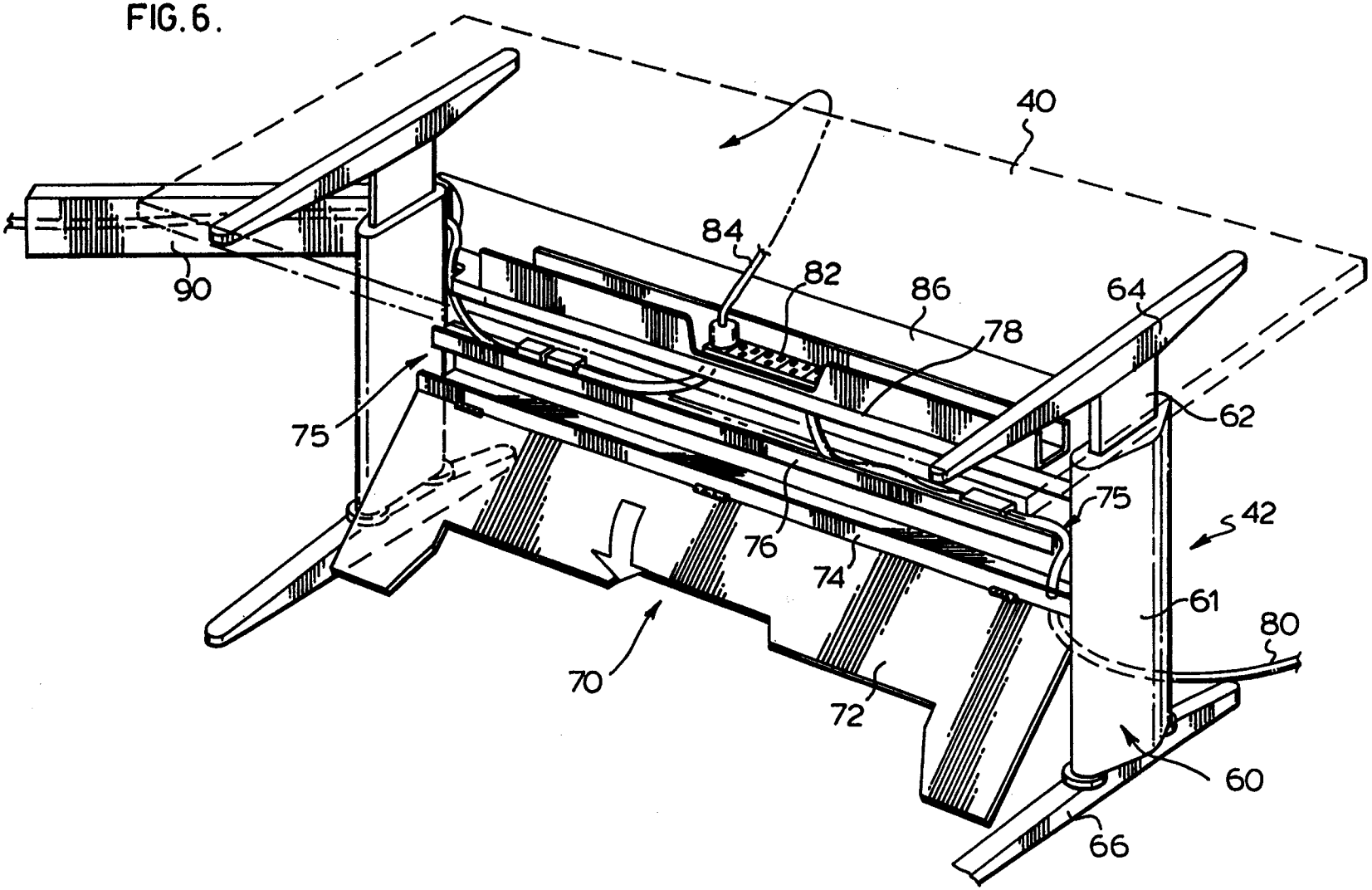
FIG. 6 is a perspective view showing one support arrangement of the desking system having associated therewith an electrical power feed arrangement.

One unit of the desking system 20 is shown in FIG. 6. Leg members 42 are positioned to either side of the work surface 40 and comprise a lower telescopic leg section 60 and upper telescopic leg section 62. The upper telescopic leg section supports a work surface engaging member 64 and preferably releasably engages a work surface in the manner shown in FIGS. 7 and 8. The lower telescopic leg sections 60 are interconnected by a connecting beam assembly 70. The beam assembly 70 includes a hinged front panel 72, a lower connecting member 74, a horizontal intermediate connecting member 76 and an upper horizontal connecting member 78. Member 76 accommodates the power feed 80 as it passes through the desking system, with horizontal connecting member 78 accommodating power outlet receptacles 82. Horizontal connecting member 74 would typically accept communication type wires which are normally spaced from the power electrical feed 80.

The hinged front panel 72 is notched in the center thereof to partially expose power receptacle 82 and allow convenient access thereto. The front panel is hinged downwardly as shown in FIG. 6 for laying in of armoured cable and communication wiring.

Figures 7, 8:
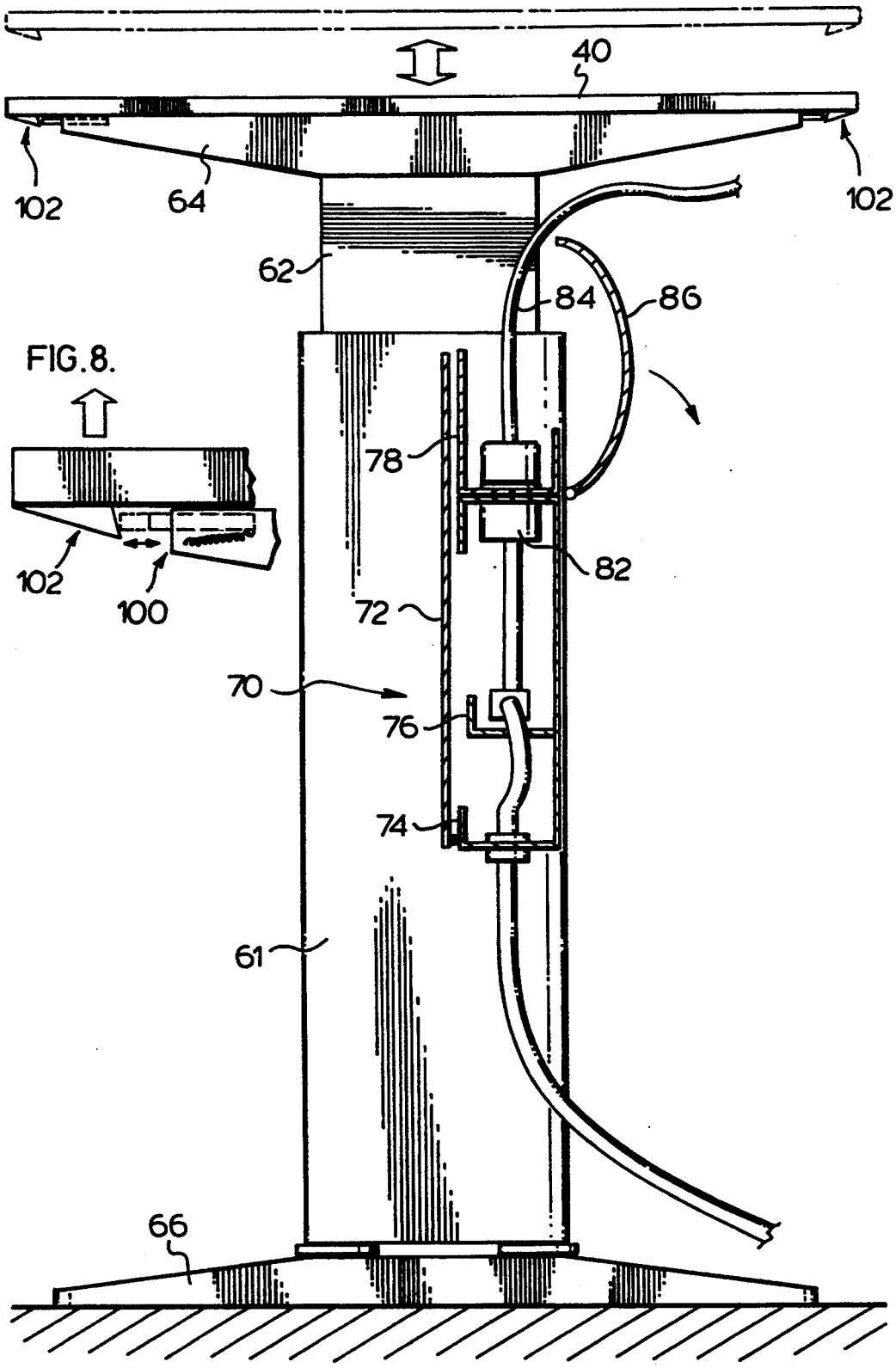
FIG. 7 is a vertical section of one of the support arrangements for the desking system.
FIG. 8 is a partial sectional view showing securement of the work surfaces of the support arrangement.
Figure 9:
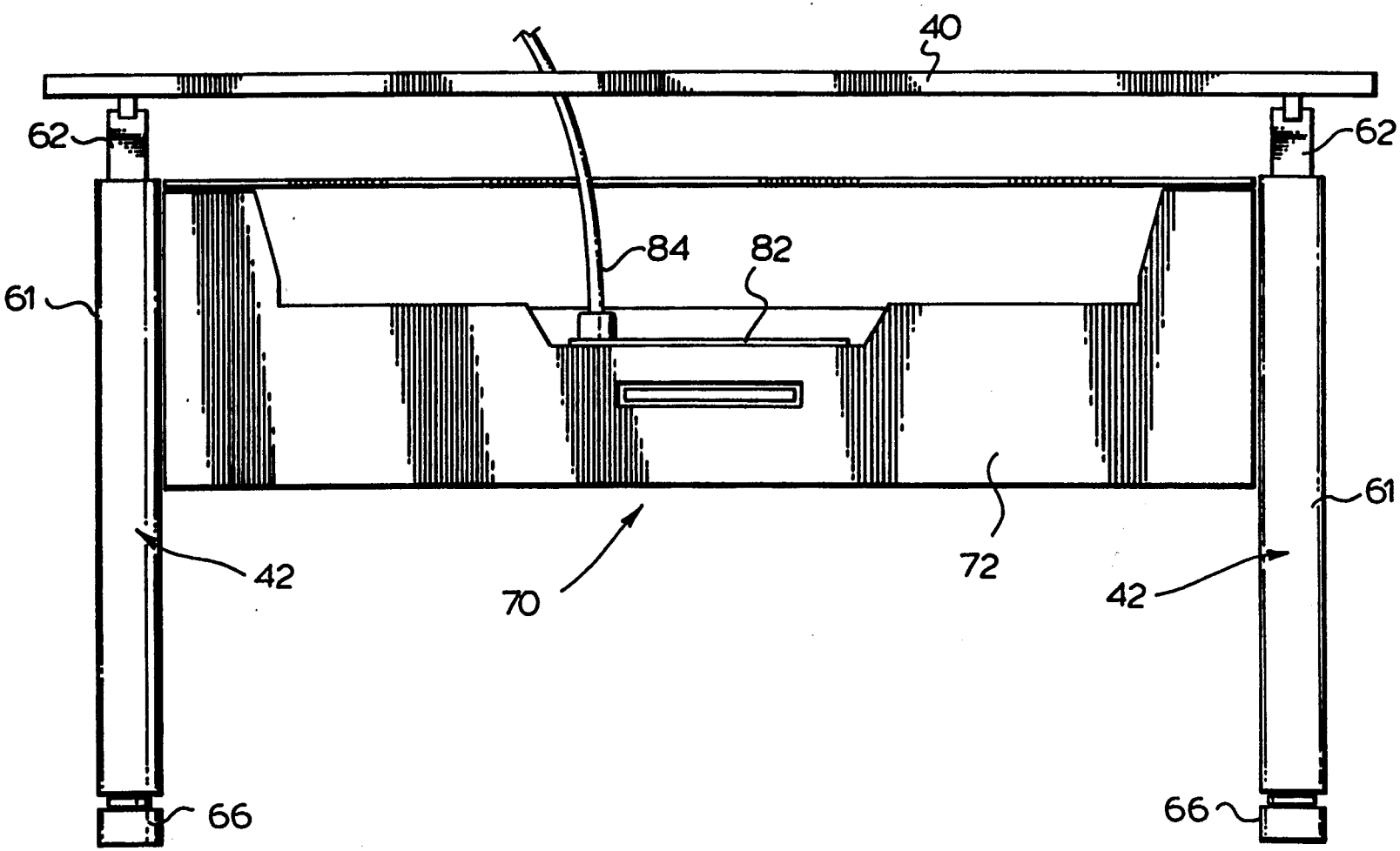
FIG. 9 is a rear view of one desk of the desking system.

A power feed 84 for office or other equipment is shown in FIG. 6 connected to the power outlet receptacle 82. The user can easily make this connection by lowering panel 72, exposing receptacle 82. The connecting beam 70 also includes a hinged back panel 86. It can be seen that when the front panel 72 is in a vertical or closed position, such as shown in FIG. 7, the front panel hides the structural features of the connecting beam assembly and the various power feeds that run therethrough or electrical connections made therein. The power feed 80 is introduced to the beam assembly adjacent the lower edge thereof and the various components allow for the feeding of cables without stringing through the system. A number of slots are provided where the horizontal connecting members join with the lower telescopic sections to accommodate the transition of electrical power and communication cables behind lower telescopic leg section 60. In some cases, it may be desirable to introduce the feed between cooperating lower telescopic sections, which is also possible and the beam assembly can have feed ports or slots appropriately spaced for feeding of wires and the like interior of the connecting beam assembly 70. The lower telescopic leg section 60 includes a removable cover arrangement 61 through which a power feed can enter the interior of the leg and gain access to the beam assembly 70. Also shown in FIG. 6 is a connecting conduit 90 which runs between adjacent lower telescopic leg sections and by means of which the power feed 80 is concealed.

The intermediate connecting member 76 has notches 77 at either end thereof creating a gap between the lower telescopic leg section 61 and the ends of the intermediate member 76. These gaps allow cables and armoured cable to pass therethrough to enter, leave or vary levels within the beam assembly. Such wires, cables, armoured cable and the like may be laid in the appropriate channel or tray from behind the beam assembly without threading through ports thus simplifying installation. Even concealment of cables by passing upward behind the removable arms of the lower telescopic leg sections without threading as the covers are removable. Similarly connecting conduit 90 can have a longitudinal open section through which wires, cables and the like may pass and lay therein.

The rear panel 86 can hinge open as indicated in FIG. 7 to provide improved access to the beam assembly from behind which is useful in laying in of cables, wires and the like to the desking system. With this arrangement the height of the work surface can be changed while the height of the beam assembly remains fixed. This is also true of the connecting conduit and overcomes problems where trays or channels are directly connected to the work surfaces.

Figure 1:
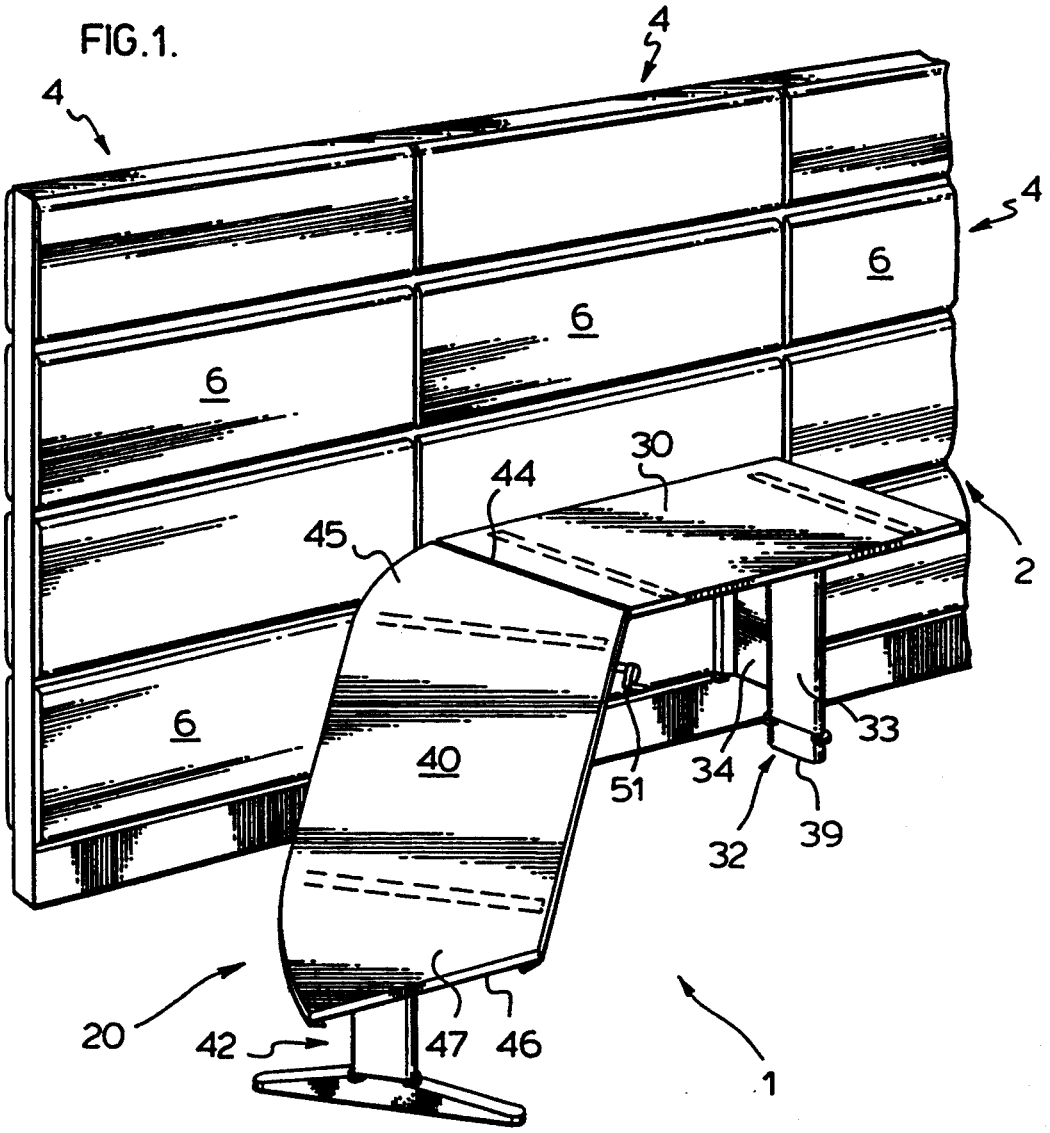
FIG. 1 is a partial perspective view of the combination office panelling and desking system.

The component of the desking system shown in FIGS. 6 and 7 is hydraulically adjustable in height and the user can easily adjust the height of the work surface 40 for his particular needs or the particular function being carried out. Adjustment is carried out by operating crank handle 51 (FIG. 1) which in turn adjusts hydraulic cylinders associated with the telescopic leg sections, as generally shown in FIG. 10.

The work surface 40 is preferably held in engagement with the work surface engaging members 64 by a spring detente arrangement, generally shown as 100. This spring detente includes a movable piston 101 which is spring biased and engages an engaging rib 102 on the lower surface of the work surface. This has been found to provide positive securement of the work surface to the support arrangement, while also allowing the user to conveniently remove the work surface without requiring any specialized tools. In most cases, a strong upward pull on the work surface will result in disengagement when piston 101 includes a camming surface to cause disengagement of the piston as the work surface is urged upwardly. With this arrangement, the work surface may be reversed, if desired, to define the opposite transition or a new work surface may be secured.

The engaging ribs 102 provided at either edge or close to the edge of the work surfaces 40 can also be used to receive accessories, such as the hydraulic adjustment arrangement 106 shown in FIG. 10. This hydraulic adjustment arrangement also includes a spring detente arrangement 102 at either end thereof which can be used for securing of this adjustment arrangement beneath the work support surface. The hydraulic adjustment arrangement 106 includes a hydraulic fluid tube 108 connected to the hydraulic cylinder 110 having displaceable piston 112. The hydraulic cylinder and piston are connected between telescopic leg sections of the central support of work surface 40c. With this arrangement, the inner telescopic section 114 of the leg arrangement 113 telescopes within the lower telescopic section 116. Lower telescopic section 116 is secured by bracket member 118 to the base 120. The hydraulic adjustment arrangement 106 may be secured to the work surface 40, shown in FIG. 5, and allows the user to adjust the height of the work surface 40*c* when operating the hydraulic adjustment arrangement 106 secured beneath work surface 40. This is particularly useful with respect to a monitor stand which can be positioned behind work surface 40. It can also be appreciated that this type of hydraulic adjustment arrangement can be used to operate to telescopic legs of the desking arrangement of FIG. 6. Preferably, a single hydraulic arrangement controls both legs.

The individual office panels 4 have various outlet ports adjacent the base thereof by means of which electrical power feeds can leave a panel 4 and eventually enter the desking system 20. In this way, power can be brought to the desking system through a panelling system or power can be brought through the desking system to the panelling system. In any event, both the panelling system and the desking system can accommodate electrical power feeds therebetween. The various work surfaces 40 can cooperate with either the support arrangement for the office panels 4 or for the independent support arrangements of the desking system. In order to simplify modification and/or changes, the desking system has separable work surfaces. This reduces the amount of overall storage necessary for defining additional work surfaces and allows for convenient transition from one longitudinal axis of the work surface to another, as certain working surfaces have included therewith a transitional segment which has a somewhat cantilevered arrangement relative to the support arrangements of either the panel or the desking system. Support of this transitional segment from the work surface of either the panelling system or the desking system, again, simplifies the system and reduces installation problems.

Although various preferred embodiments of the present invention have been described herein in detail, it will be appreciated by those skilled in the art, that variations may be made thereto without departing from the spirit of the invention or the scope of the appended claims.

The embodiments of the invention in which an exclusive property or privilege is claimed are defined as follows:

1. A system for subdividing office space into a plurality of work stations, said system comprising mechanically secured office panels with at least some of said office panels supporting work surfaces to at least one side of said office panels, and some of said work stations being defined by a desking arrangement having work surfaces supported independent of said office panels; characterised in that said office panels each include a rigid rectangular frame with at least one intermediate horizontal securing channel extending across said panel and forming a securing structure running the length of the panel and accessible between removable functional cover elements of said office panels at a multiplicity of locations distributed along said securing channel; said horizontal securing channels cooperating with and supporting to one side of said panels vertical support members of at least some of said work surfaces supported from said panels, each vertical support member including a projecting member extending into and being restricted by the cooperating horizontal securing channel it engages at any of said multiplicity of locations therealong; and wherein at least one of said work stations is defined by work surfaces supported by the combined office panels and said desking arrangement where the work surfaces thereof are joined at a transition position intermediate the length of a panel where one end of a work surface adjacent said transition position is supported from one of said panels intermediate the length of the supporting panel; said office panels and said desking arrangement cooperating such that transition positions can occur at any of said multiplicity of locations of said securing channel of said one panel, which locations are intermediate the length of a panel.

2. A system as claimed in claim 1 wherein at least some of said work surfaces can be interchangeably supported by said desking arrangement or said panels.

3. A system as claimed in claim 1 including a supply of interchangeable work surfaces with some of said work surfaces having transitional segments of forming an angle connection between work surface supported by said panels and work surfaces which are part of said desking arrangement, said supply of work surfaces allowing the work surface configuration to change by interchange of work surfaces.

4. A system as claimed in claim 3 wherein said work surfaces include a plurality of transition work surfaces, each transition work surface having opposed offset end configurations to define said transition position in a longitudinal axis of the work surface formed between two adjacent work surfaces one supported from said office panels and one supported from said desking arrangement.

5. A system as claimed in claim 1 wherein each frame includes two vertically spaced securing channels and each of said vertical support members engage said channels.

6. A system as claimed in claim 1 wherein said work surfaces are maintained in engagement with support means of said panels and support means of said desking system by a spring detente arrangement and are releasable from said spring detente arrangement by applying an upward force on said work surfaces.

7. A system as claimed in claim 4 wherein said transition position is part of one of the work surfaces of said desking arrangement or said panels.

8. A system as claimed in claim 7 wherein said transition work surfaces each include a transition segment at one end of the work surface and said transition segment is at least primarily supported in a cantilevered manner by said office panels.

9. A system as claimed in claim 8 wherein said transition work surfaces define a transitions selected from the group of 15°, 30°, 45°, 60°, 90°, 120°, 135°, 150°, and 180°.

10. A system as claimed in claim 1 wherein electrical power and or communication feeds are interconnected and pass between the panels and the desking arrangement.

11. In a system as claimed in claim 1 wherein said work surfaces are removable in segments, some of which terminate at a position intermediate the length of a panel, without detachment from adjacent segments.

12. In a system as described in claim 1 including floor plates which engage legs of said desking systems at a transition position between work surfaces thereof disposed in a particular angular orientation to maintain said particular angular orientation therebetween.

* * * * *